US005233746A

United States Patent [19]

Heintke

[11] Patent Number: 5,233,746

[45] Date of Patent: Aug. 10, 1993

[54] ELECTRIC SHAVING APPARATUS

[75] Inventor: Hans-Eberhard Heintke, Wächtersbach, Fed. Rep. of Germany

[73] Assignee: Braun Aktiengesellschaft, Frankfurt, Fed. Rep. of Germany

[21] Appl. No.: 931,841

[22] Filed: Aug. 18, 1992

[30] Foreign Application Priority Data

Aug. 26, 1991 [DE] Fed. Rep. of Germany ..... 4128221

[51] Int. Cl.[5] ..... B26B 19/06; B26B 19/00; B26B 21/14

[52] U.S. Cl. ..... 30/34.05; 30/43.1; 30/89

[58] Field of Search ..... 30/34.05, 34.1, 43.1, 30/43.92, 89, 34.2, 43.91, 43.3

[56] References Cited

U.S. PATENT DOCUMENTS

| | | | |
|---|---|---|---|
| 3,797,109 | 3/1974 | Yamada et al. | 30/43.1 |
| 3,945,115 | 3/1970 | Daniels et al. | 30/43.1 |
| 3,973,323 | 8/1976 | Trees . | |
| 4,688,329 | 8/1987 | Oord . | |
| 4,796,359 | 1/1989 | Oprach et al. | 30/89 |
| 4,797,997 | 1/1989 | Packham | 30/43.1 |
| 4,922,608 | 5/1990 | Pahl | 30/34.1 |
| 4,930,217 | 6/1990 | Wolf et al. . | |

FOREIGN PATENT DOCUMENTS

| | | |
|---|---|---|
| 3726354C2 | 8/1987 | Fed. Rep. of Germany . |
| 4000689C1 | 1/1990 | Fed. Rep. of Germany . |

*Primary Examiner*—Frank T. Yost
*Assistant Examiner*—Paul M. Heyrana, Jr.
*Attorney, Agent, or Firm*—Fish & Richardson

[57] ABSTRACT

The invention is directed to an electric shaving apparatus having a housing 1 and a shaving head 2 mounted so as to be pivotal relative to the housing 1 about a pivotal axis Z, having an outer cutter 36 and an inner cutter 31 operatively associated with the outer cutter 36 and driven by a motor, and further having an actuating switch 4 which is provided on the housing 1 and is equipped with a control device for displacing at least one slidably mounted control element 33 which engages in the pivot area 10 of the shaving head 2, limits the pivotal movement of the shaving head 2, and is guided along a cam path 13. The cam path 13 is integrally formed in the shaving head 2 such that, on displacement of the actuating switch 4 into an Off position, the shaving head 2 is forced into a mid-position in which it is capable of being locked.

21 Claims, 3 Drawing Sheets

ELECTRIC SHAVING APPARATUS

Figure 1:
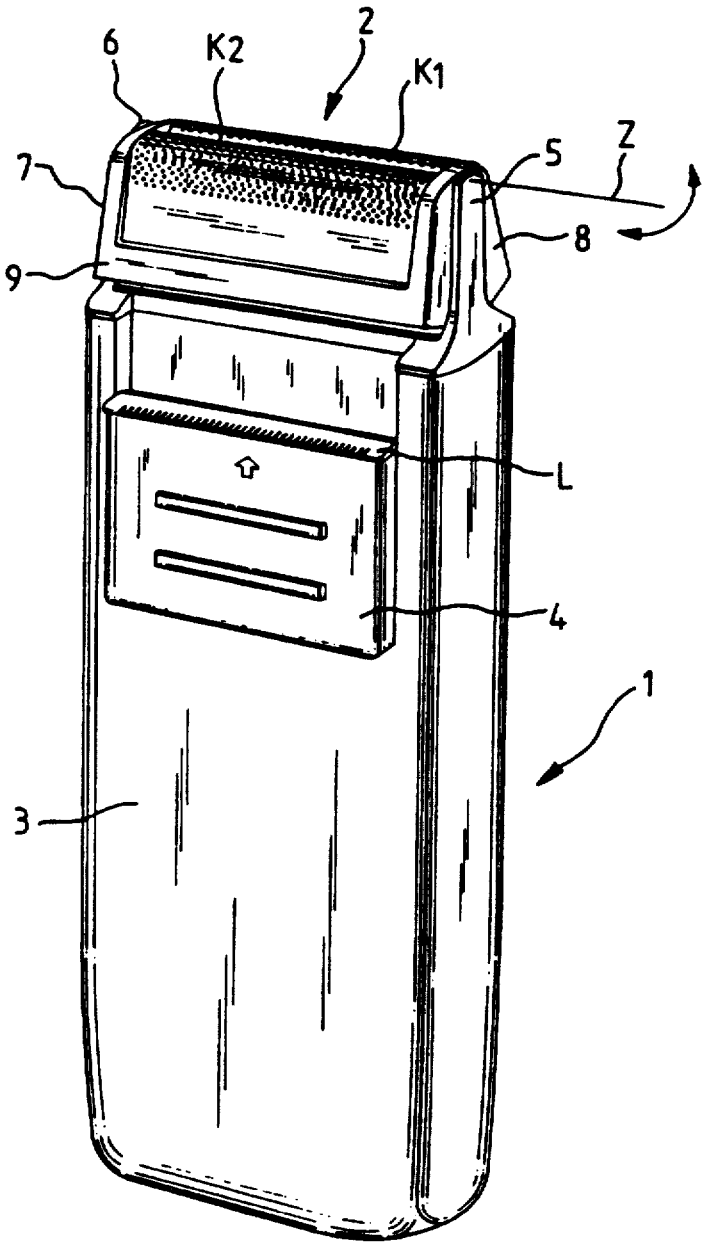

This invention relates to an electric shaving apparatus having a housing and a shaving head mounted so as to be pivotal relative to the housing about a pivotal axis, having at least one outer cutter and at least one inner cutter operatively associated with the outer cutter and driven by a motor, and further having at least one actuating switch which is provided on the housing and is adapted to be coupled to a control device cooperating with a slidably mounted control element engaging in the pivot area of the shaving head and adapted to be moved into abutting engagement with a cam path for locking the shaving head in at least one position.

In a shaving apparatus of the type referred to in U.S. Pat. No. 4,930,214, it is known to provide on the housing of the shaving apparatus a shaving head which is adapted to pivot freely in any pivotal position and has associated to it an actuating switch slidably mounted on the housing. The actuating switch is operatively associated with a control device serving to displace a slidable control element which is guided along a cam path, engages in the pivot area of the shaving head and limits the pivotal movement of the shaving head. With this control device, the shaving head can not be locked in position until after starting operation of the shaving apparatus, a locked position being not possible in the Off condition of the shaving apparatus.

Accordingly, it is an object of the present invention to provide an improved electric shaving apparatus.

This object is accomplished by the present invention in that the cam path is integrally formed in the shaving head such that, with the shaving apparatus assuming an operating position, the control element is disengaged from the cam path and that, with the shaving apparatus assuming an Off position, the control element is moved into engagement with the cam path, thereby forcing the shaving head into a mid-position. In this manner it is ensured that deactivation of the appliance, for example, simultaneously returns the shaving head to its mid-position.

To this effect, it is advantageous that the cam path integrally formed in the shaving head is concave and concentrically arranged with the pivotal axis of the shaving head, that the cam path includes a locating position concentrically arranged with the center axis of the shaving apparatus, and that the shaving head is automatically movable along the cam path from any pivotal position into the locating position predetermined in relation to the center axis of the shaving apparatus and is capable of being locked in this position. This advantageous arrangement accordingly ensures that on movement of the slide switch from an operating position into an Off position the shaving head reaches automatically its mid-position in which it is locked in position. As a result, the appliance can be cleaned with substantially greater ease than has hitherto been possible. In particular in transit, the shaving head is prevented from moving to and fro. The control device of the invention operates independently of other control devices provided for positioning the pivotally mounted shaving head during shaving, that is, with the shaving apparatus in operation.

Further, it is advantageous that the locating position predetermined in relation to the center axis of the shaving apparatus is configured as a locating slot integrally formed in the cam path, and the actuating switch cooperates with the locating slot concentrically formed in the cam path by means of a slide member extending parallel to the center axis of the shaving apparatus.

In a further aspect of the device of the present invention, another possibility is afforded by arranging for the slide member to be insertable into the locating slot concentrically formed in the cam path.

In a still further aspect of the present invention, the slide member is equipped with a receiving means accommodating a spring bearing with one end against a stationary part of the shaving apparatus and with its other end against the slide member, the spring urging the slide member into a position locking the shaving head when the actuating switch is in a particular position. As a result of this arrangement, the slide member is automatically moved into a position allowing a pivotal movement of the shaving head when the actuating switch is moved from its Off position into an operating position, thereby enabling the shaving head to pivot freely relative to the housing about its axis.

In another feature of the device of the present invention, the cam path formed in the shaving head is arranged concentrically with the pivotal axis of the shaving head.

In still another feature of the present invention, a second cam path or sliding path is advantageously arranged opposite the cam path formed in the shaving head, which second cam path is provided between the outer cutter of the shaving apparatus and the first cam path, and in the position allowing a pivotal movement of the shaving head the outer end of the slide member is movable into abutting engagement with the second cam path, cushioning the pivotal movement of the shaving head. This is a simple means of preventing the occurrence of disagreeable noise during the shave, in particular rattling, striking or bouncing noise.

In a preferred embodiment of the present invention, a head provided at the outer end of the slide member is arranged to protrude from one side of the slide member, and the slide member is received in a cavity provided in the housing of the shaving apparatus and extends through a cutout of a shaving head carrier associated with the shaving head.

It is of particular relevance to the present invention that the slide switch is equipped with an elongate opening downwardly open in the direction of movement of the actuating switch, that is, it has such a large clearance that movement of the actuating switch into any one of the positions "1", "2" or "3" has no effect on the position of the slide member.

In connection with the arrangement it is advantageous that the slide member has at its end remote from the shaving head a hook engaging in the opening, the opening having a stop which, on movement of the slide switch from an operating position into an Off position "0", moves into abutting engagement with the hook, thus causing the slide member to assume a position locking the shaving head.

Further advantageous embodiments of the present invention are set out and illustrated in the subclaims, the description and, respectively, the Figures, it being understood that any single feature and any combination of single features are essential to the invention.

Figure 2:
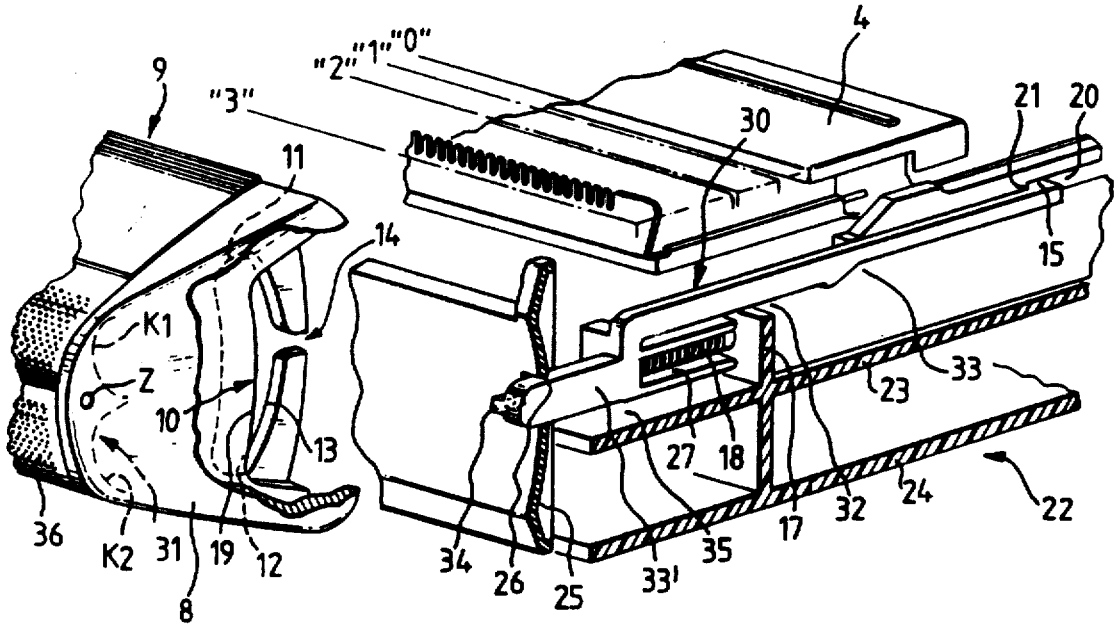
Figure 3:
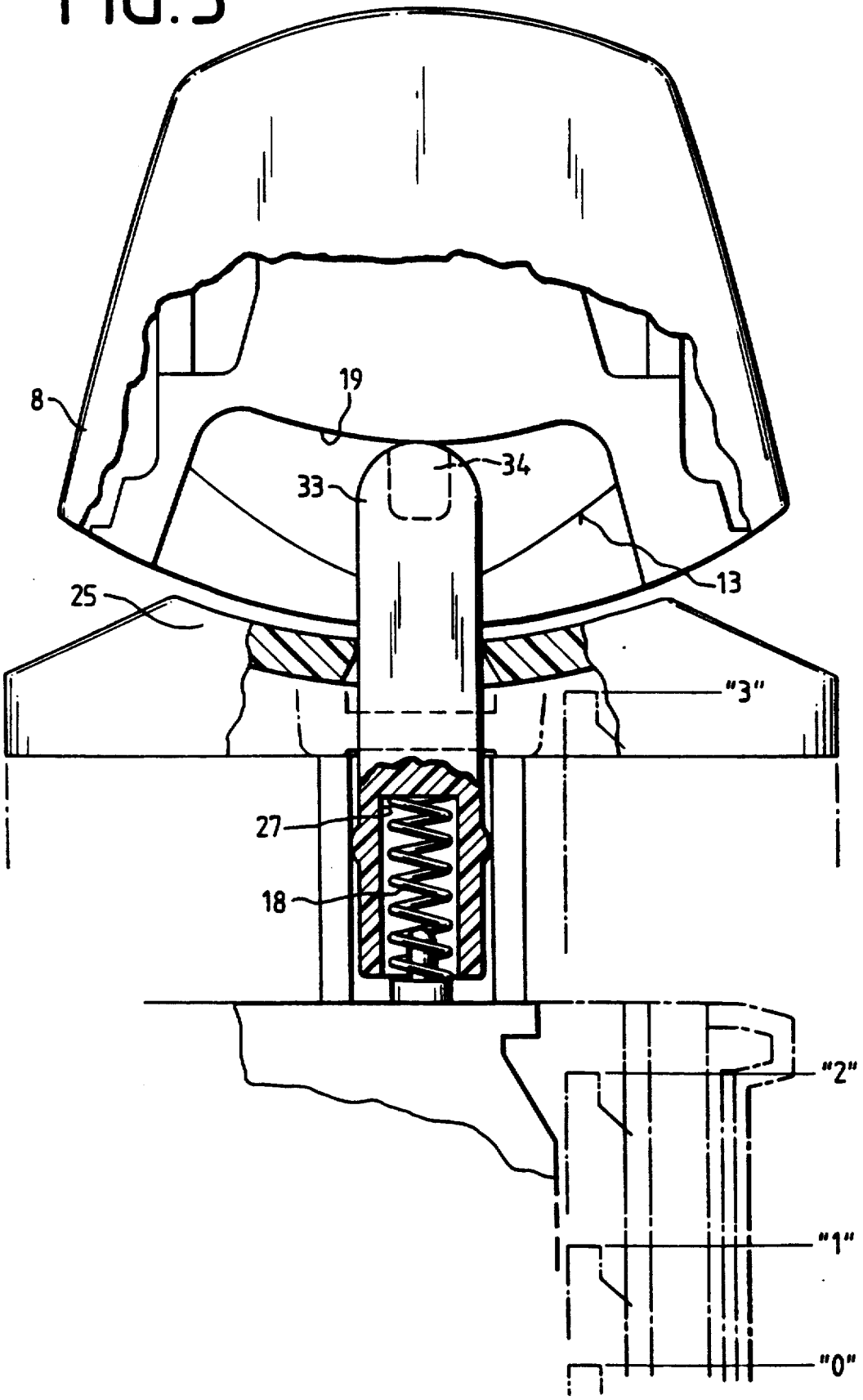

An embodiment of the present invention will now be described, by way of example, without being limited to this particular embodiment, reference being had to the accompanying drawings. In the drawings, FIG. 1 is a perspective view of a shaving apparatus including a pivotally mounted shaving head as well as an actuating switch equipped with a long-hair trimmer;

FIG. 2 is an exploded view of the shaving head and part of the housing body of a shaving apparatus, with the walls of the housing body being partly broken away, as well as an actuating switch arranged on the front panel and cooperating with a slide member for locking the shaving head in position, the housing having been omitted for improved clarity of the illustration of the shaver function; and FIG. 3 is a partial longitudinal sectional view of the shaving apparatus of FIG. 1 including the pivotally mounted shaving head.

Referring now to FIG. 1 of the drawings, there is shown an electric shaving apparatus having a housing 1 and a shaving head 2 pivotal relative to the housing about a pivotal axis Z from the mid-position shown into opposite directions, with two short-hair cutter assemblies $K_1$, $K_2$ as well as an actuating switch 4 slidably arranged on the front panel 3 of the housing 1 and incorporating a built-in long-hair trimmer L. The shaving head 2 is pivotally mounted relative to the housing 1 and equipped with an outer cutter 36 and an inner cutter 31 operatively associated with the outer cutter 36 and driven by a motor. By means of bearing elements not shown in the drawings, the shaving head 2 is held in a freely pivotal relationship between two support lugs 5, 6 formed on the housing 1.

The actuating switch 4 integrally formed with the long-hair trimmer L is slidably mounted on the front panel 3 of the housing 1. Formed on the actuating switch 4 is a switch coulisse not shown in the drawings having four settings "0, 1, 2, 3" determining the individual positions of the actuating switch 4.

The position "Off" corresponds to the setting "0" of the actuating switch 4.

To operate the electric drive mechanism of the shaving apparatus and thus the cutter assembly or assemblies provided in the shaving head 2, the actuating switch 4 is pushed to position "1". Moving the actuating switch 4 to position "2" activates also the long-hair trimmer L integrated into the actuating switch.

FIG. 2 shows an exploded view of the shaving head 2 and the upper part of the housing 1 of a shaving apparatus in which the walls of the housing 1 are partly broken away, as well as an actuating switch 4 arranged on the front panel 3 and configured as a dual switch comprising an actuating part not shown and a long-hair trimmer L. In the end walls 7 and 8 of the shaving head 2, bearing pins are provided by means of which the shaving head 2 is carried in bearing bores provided in the support lugs 5 and 6 so as to be pivotal about the pivotal axis Z. Pivot areas 10 of identical configuration are formed in the end walls 7 and 8. The pivot area 10 formed in the end wall 8 is configured as a recess. The end wall is constructed such as to provide a lower cam path 13 functioning as a sequential control element having a locating slot 14, with abutment stops 11, 12 being provided at the respective ends for limiting the cam path 13.

FIG. 3 further shows a partial representation of the shaving apparatus 1 of FIG. 1 incorporating a control means 30 for the pivoted shaving head.

Serving as a control element is a stepped slide member 33 which is carried in an end wall, not shown in FIG. 2, of the housing 1 and is slidable in the longitudinal direction of the shaving apparatus in opposition to the pressure of a spring 18 bearing with one end against the slide member 33 while its other end rests against a rib member 17 secured in the housing 1. The rib member 17 is fixedly connected to, that is, integrally formed with, parallel wall portions 23, 24 of the housing body 22.

Adjoining the cam path 13 is another cam path or sliding path 19 extending in convex shape at a distance to the cam path 13 and adapted for abutting engagement with a head 34 disposed on the slide member 33, which occurs when the slide member 33 has been displaced on movement of the actuating switch 4 from position "0" to any one of the positions "1" to "3".

The slide member 33 is arranged underneath the actuating switch 4, extending through an aperture 32 provided between the actuating switch 4 and the rib member 17.

At its right-hand end when viewing FIG. 2, that is, at its end remote from the shaving head 2, the slide member 33 has a hook 15 engaging in an opening 20 provided on the actuating switch 4, the opening being configured as an elongate hole which is open downwardly in the direction of movement of the actuating switch 4, that is, it has such a large clearance that a movement of the actuating switch 4 into any one of the positions "1", "2" or "3" has no effect on the position of the slide member 33. By contrast, if the actuating switch 4 is moved from position "1" to position "0", a stop wall 21 in the opening 20 will engage the hook 15, shifting the slide member 33 into the position "0".

At the upper end of the housing body 22, a shaving head carrier 25 is provided for pivotally mounting the shaving head 2 which is pivotally received only in the support lugs 5, 6 illustrated in FIG. 1.

At the one end of the shaving head carrier 25, a rectangular cutout 26 configured as a guiding means for the slide member is provided, the cutout receiving the upper end of the slide member 33 in a slidable relationship thereto.

As becomes further apparent from FIG. 2, the upper end of a stepped portion 33' of the slide member is adjustably received in a cavity 35 formed between the shaving head carrier 25 and the rib member 17. The stepped portion 33' of the slide member 33 includes a blind-end hole 27 for accommodating the spring 18 bearing with one end against the inner end of the blind-end hole 27 while its other end takes support upon the rib member 17, thereby urging the slide member 33 with its head 34 into abutment with the slide path 19 when the actuating switch 4 is in any one of the positions "1", "2" or "3".

As becomes apparent from FIGS. 2 and 3, the head 34 is fixedly attached to the upper end of the slide member 33 and, with the actuating switch 4 in the position "0", is inserted into the locating slot 14 provided in the cam path 13, thereby preventing the shaving head 2 from being pivoted about its pivotal axis Z. The shaving head 2 being locked in this position, it can be cleaned with substantially greater ease after the shave.

For this purpose, the actuating switch 4 is pushed from position "1" to position "0". This involves movement of the stop wall 21 of the actuating switch 4 into abutting engagement with the hook 15 of the slide member 33 which is displaced to the right when viewing the drawing. As this operation occurs, the head 34 of the slide member will be simultaneously displaced in the direction of the interior of the housing 1. If the shaving head 2 is in an inclined position, the head 34 of the slide member will travel along the surface of the cam path 13, thereby forcing the shaving head 2 into its mid-position shown in FIG. 3, locking it in this position.

When the actuating switch 4 is pushed from position "0", that is from the position locking the shaving head 2, to position "1", the spring 18 will urge the slide member 33 into the direction of the shaving head 2, causing the head 34 of the slide member to be disengaged from its locating slot 14. As becomes apparent from the dot-and-dash lines of FIG. 2, the head 34 may protrude laterally from the upper end of the slide member 33, enabling the outer end surface of the slide member 33 to abut the inner end wall 8 of the shaving head 2 if the cutout 26 is laterally open. In position "1", the end of the slide member 33 pointing in the direction of the shaving head 2 as well as the end of the head 34 pointing upwardly rest against the slide path 19 of the shaving head 2. By virtue of the sliding friction produced by the abutting engagement between the surface of the slide path 19 and the respective outer ends of the slide member 33 and the head 34, a minor cushioning effect is achieved preventing noise caused by movements including, for example, rattling, bouncing or hard striking of the shaving head 2.

When the actuating switch 4 is moved to the next setting "2" or "3", further displacement of the slide member 33 through the actuating switch 4 is prevented from occurring due to the correspondingly large opening 20, that is, the connection between the actuating switch 4 and the slide member 33 is interrupted in the settings "1", "2" or "3".

While the slide member 33 is illustrated as being provided at one end wall only in FIGS. 2 and 3, it will be understood that it may be provided at both end walls of the shaving apparatus.

On returning the actuating switch 4 to position "Off", that is, the "0" setting, the electric drive of the shaving apparatus will be deactivated and the head 34 of the slide member will again lock the shaving head 2 in its mid-position.

The components of the control device for the shaving head 2 pivotally mounted about the pivotal axis Z as described in FIGS. 1 to 3 may be arranged in a symmetrical relationship to each other on one of the end walls of the shaving apparatus shown.

I claim:

1. An electric shaving apparatus comprising housing structure, a shaving head mounted on said housing structure for pivotal movement relative to said housing structure about a pivotal axis (Z), said shaving head having at least one outer cutter and at least one inner cutter operatively associated with said outer cutter, first cam path structure integrally formed in said shaving head, an electric motor in said housing structure for driving said inner cutter relative to said outer cutter, actuating switch structure including a slidably mounted control element on said housing structure for movement between an "OFF" position in which said electric motor is deenergized and an operating position in which said electric motor is energized, a control device cooperating with said slidably mounted control element and disposed in the pivot area of said shaving head for movement into abutting engagement with said first cam path structure for locking said shaving head in at least one position such that, when said control element is moved from said Off position to said operating position, said control device is disengaged from said first cam path structure and that, when said control element is moved to said Off position, said control device is moved into engagement with said first cam path structure, thereby forcing said shaving head into a mid-position.

2. The shaving apparatus as claimed in claim 1 wherein said first cam path structure is concave and concentrically arranged with respect to the pivotal axis (Z) of said shaving head.

3. The shaving apparatus as claimed in claim 1 wherein said first cam path structure includes a locating position concentrically arranged with respect to the center axis of said shaving head.

4. The shaving apparatus as claimed in claim 3 wherein movement of said control element from said operating position to said Off position moves said control device along said cam path structure into engagement with said locating position to automatically move said shaving head from any pivotal position into said locating position in predetermined relation to the center axis of said shaving head for locking said shaving head in said locating position.

5. The shaving apparatus as claimed in claim 1 wherein said locating position is a locating slot integrally formed in said first cam path structure.

6. The shaving apparatus as claimed in claim 5 wherein said control device includes a slide member configured as an actuating member that extends parallel to the center axis of said shaving apparatus and that cooperates with said locating slot.

7. The shaving apparatus as claimed in claim 6 wherein said slide member is insertable into said locating slot.

8. The shaving apparatus as claimed in claim 6 wherein said actuating switch structure includes a spring and spring receiving means accommodating said spring such that one end of said spring bears against a stationary part of said shaving apparatus and with the other end of said spring bears against said slide member, said spring urging said slide member into a position unlocking said shaving head when said actuating switch structure is displaced to said operating position.

9. The shaving apparatus as claimed in claim 6 wherein the end of said slide member proximate to said shaving head is provided with a portion which, on displacement of said actuating switch structure from said operating position to said Off position, is guided along said first cam path structure until said slide member is introduced into said locating slot of said cam path structure.

10. The shaving apparatus as claimed in claim 1 and further including second cam path structure arranged opposite said first cam path structure, said second cam path structure being disposed between said outer cutter of said shaving apparatus and said first cam path structure.

11. The shaving apparatus as claimed in claim 10 wherein in the operating position of said control element, said control device is in abutting engagement with said second cam path structure for cushioning movement of said shaving head.

12. The shaving apparatus as claimed in claim 11 wherein said first cam path structure is concave and concentrically arranged with respect to the pivotal axis (Z) of said shaving head.

13. The shaving apparatus as claimed in claim 12 wherein said first cam path structure includes a locating position concentrically arranged with respect to the center axis of said shaving head.

14. The shaving apparatus as claimed in claim 13 wherein movement of said control element from said operating position to said Off position moves said control device along said cam path structure into engagement with said locating position to automatically move said shaving head from any pivotal position into said locating position in predetermined relation to the center axis of said shaving head for locking said shaving head in said locating position.

15. The shaving apparatus as claimed in claim 14 wherein said locating position is a locating slot integrally formed in said first cam path structure.

16. The shaving apparatus as claimed in claim 15 wherein said control device includes a slide member configured as an actuating member that extends parallel to the center axis of said shaving apparatus and that is insertable into said locating slot.

17. The shaving apparatus as claimed in claim 16 wherein said actuating switch structure includes a spring and spring receiving means accommodating said spring such that one end of said spring bears against a stationary part of said shaving apparatus and with the other end of said spring bears against said slide member, said spring urging said slide member into a position unlocking said shaving head when said actuating switch structure is displaced to said operating position.

18. The shaving apparatus as claimed in claim 10 wherein said control device includes a slide member configured as an actuating member that extends parallel to the center axis of said shaving apparatus and further including a head portion at the outer end of said slide member that protrudes from one side of said slide member.

19. The shaving apparatus as claimed in claim 1 wherein said control device includes a slide member configured as an actuating member that extends parallel to the center axis of said shaving apparatus, said slide member being received in a cavity in said housing structure and extends through, and is guided in, a cutout associated with said shaving head.

20. The shaving apparatus as claimed in claim 1 wherein said control device includes a slide member configured as an actuating member that extends parallel to the center axis of said shaving apparatus, and said control element includes an elongate opening which is open in the direction of movement of said actuating switch structure, said opening having sufficient clearance such that movement of said actuating switch structure between a plurality of operating positions has no effect on the position of said slide member.

21. The shaving apparatus as claimed in claim 20 wherein said slide member has, at its end remote from said shaving head, hook structure engaging in said opening, said opening having stop structure which, on movement of said actuating switch structure from an operating position to said Off position, moves into abutting engagement with said hook structure, thus causing said slide member to lock said shaving head.

* * * * *

UNITED STATES PATENT AND TRADEMARK OFFICE

CERTIFICATE OF CORRECTION

PATENT NO. : 5,233,746

DATED : August 10, 1993

INVENTOR(S) : Hans-Eberhard Heintke

It is certified that error appears in the above-indentified patent and that said Letters Patent is hereby corrected as shown below:

Col. 1, line 17, "4,930,214" should be --4,930,217--.

Signed and Sealed this

Eighth Day of March, 1994

Bruce Lehman

*Attest:*

BRUCE LEHMAN

*Attesting Officer*

*Commissioner of Patents and Trademarks*